US010058791B2

(12) United States Patent
Norfleet

(10) Patent No.: US 10,058,791 B2
(45) Date of Patent: Aug. 28, 2018

(54) WALL ASSEMBLY AND ALIGNMENT CLIPS FOR ASSEMBLING MINIATURE MODEL BUILDINGS

(71) Applicant: George McKinley Norfleet, Washington, DC (US)

(72) Inventor: George McKinley Norfleet, Washington, DC (US)

( * ) Notice: Subject to any disclaimer, the term of this patent is extended or adjusted under 35 U.S.C. 154(b) by 0 days.

(21) Appl. No.: 15/451,764

(22) Filed: Mar. 7, 2017

(65) Prior Publication Data

US 2017/0252665 A1 Sep. 7, 2017

Related U.S. Application Data

(60) Provisional application No. 62/304,486, filed on Mar. 7, 2016.

(51) Int. Cl.

| | |
|---|---|
| ***A63H 33/08*** | (2006.01) |
| ***A63H 33/04*** | (2006.01) |
| ***A63H 33/10*** | (2006.01) |

(52) U.S. Cl.

CPC ..... *A63H 33/044* (2013.01); *A63H 33/105* (2013.01)

(58) Field of Classification Search

CPC .... A63H 33/044; A63H 33/10; A63H 33/062; A63H 33/08; A63H 33/04

USPC ..... 446/108–116, 122, 124, 105; 52/234

See application file for complete search history.

(56) References Cited

U.S. PATENT DOCUMENTS

| | | | | | |
|---|---|---|---|---|---|
| 1,193,975 | A * | 8/1916 | Beardsley | A63H 3/52 | 446/109 |
| 1,302,785 | A * | 5/1919 | Gilbert | A63H 33/105 | 446/112 |
| 1,608,273 | A | 11/1926 | Glasgow | | |
| 1,886,363 | A | 11/1932 | Aufderheide | | |
| 1,913,066 | A | 6/1933 | Carter | | |
| 2,143,667 | A * | 1/1939 | Troiel | A63H 33/105 | 446/122 |
| 2,204,319 | A * | 6/1940 | Parsons | A63H 33/044 | 446/112 |
| 2,522,149 | A * | 9/1950 | Tunstall | A63H 33/044 | 434/79 |
| 2,559,261 | A * | 7/1951 | Schwartz | A63H 33/044 | 434/72 |
| 2,647,287 | A | 8/1953 | Jones | | |

(Continued)

*Primary Examiner* — Gene Kim
*Assistant Examiner* — Matthew B Stanczak
(74) *Attorney, Agent, or Firm* — Cahn & Samuels, LLP

(57) ABSTRACT

A wall component for receiving associated alignment clips is illustrated and described. The wall component comprises a molding strip, an array of mounting studs, and a molding frame that is inserted between a pair of wall panels. More specifically, the mounting studs are affixed to an inner surface of the molding strip and inserted through the wall panel where they are secured to the molding frame. A gap is formed between the inner surface of the molding strip and an outer surface of the wall panel for receiving associated alignment clips. The alignment clips are releasably secured to the wall component by interlocking with the mounting studs in the clip receiving gap and/or wedging the gap. The alignment clips may be affixed along an abutment edge of the wall segment or to associated model pieces. Model pieces may also be laterally slidable with respect to their associated alignment clips.

1 Claim, 6 Drawing Sheets

(56) References Cited

U.S. PATENT DOCUMENTS 2,904,927 A 9/1959 Katz
2,931,130 A 4/1960 Rietz
3,002,315 A 10/1961 Kuhn
3,269,034 A * 8/1966 Glass ..... A63H 3/52 434/80
3,295,225 A * 1/1967 Sodergren ..... G09B 25/04 434/72
3,305,982 A 2/1967 Steele
3,372,519 A 3/1968 Russell
3,387,733 A 6/1968 Field
3,392,497 A 7/1968 Cushman
3,452,498 A 7/1969 Kinsey
3,526,054 A * 9/1970 Raman ..... A63H 33/042 446/112
3,603,004 A * 9/1971 Fink ..... G09B 25/08 434/73
3,719,001 A * 3/1973 Archer ..... A63H 3/52 446/115
3,902,291 A 9/1975 Zucht
3,958,386 A 5/1976 Pollock
3,996,693 A * 12/1976 Walmer ..... A63H 3/52 446/105
4,193,221 A * 3/1980 Beck ..... A63H 33/044 446/105
4,227,337 A * 10/1980 Murray ..... A63H 33/044 446/102
4,270,302 A * 6/1981 Dandia ..... A63H 33/044 446/105
4,270,303 A 6/1981 Xanthopoulos
4,400,906 A * 8/1983 Bove ..... A63H 33/044 446/110
4,467,572 A * 8/1984 Somers ..... A63H 33/008 16/225
5,002,513 A * 3/1991 Weiss ..... A63H 33/044 446/110
5,134,826 A 8/1992 La Roche et al.
5,195,282 A 3/1993 Campbell
5,222,902 A 6/1993 Piersch
5,487,241 A 1/1996 Gorell et al.
5,762,530 A * 6/1998 Zheng ..... A63F 9/12 273/160
5,779,517 A 7/1998 Clarke
5,797,219 A * 8/1998 Croswell ..... A63H 33/044 446/110
5,868,574 A * 2/1999 Randle ..... G09B 25/04 434/370
5,910,037 A * 6/1999 Bach ..... A63H 33/04 434/80
6,073,404 A * 6/2000 Norfleet ..... A63H 33/044 446/109
6,261,147 B1 * 7/2001 Bach ..... A63H 3/52 446/105
6,283,818 B1 * 9/2001 Kushner ..... A63H 33/044 434/72
6,370,835 B1 4/2002 Morgan et al.
6,524,107 B1 * 2/2003 Brown ..... G09B 25/04 434/72
6,598,363 B1 7/2003 Ferguson et al.
6,645,032 B2 11/2003 Barringer et al.
6,715,826 B2 4/2004 Bellows et al.
6,746,297 B2 6/2004 Robjent et al.
6,802,160 B2 * 10/2004 Harambasic ..... E04B 1/04 446/124
6,905,338 B1 6/2005 Garran
7,019,759 B1 3/2006 Moore et al.
7,156,663 B1 1/2007 Gerhart
7,186,161 B2 3/2007 Salas Peralta
7,229,334 B2 * 6/2007 Ishikawa ..... A63H 33/042 446/110
7,237,368 B2 7/2007 Richardson et al.
7,241,198 B1 7/2007 Boone
7,581,357 B2 * 9/2009 Richardson ..... E04B 1/34321 446/105
7,814,710 B2 10/2010 Foglia
7,968,473 B2 6/2011 Parihar et al.
8,006,451 B2 8/2011 Bond
8,021,155 B2 9/2011 Rasmussen
8,113,840 B2 * 2/2012 Kuhn ..... G09B 25/04 434/72
8,338,316 B2 12/2012 Parihar et al.
8,365,489 B1 2/2013 Bond
8,568,187 B2 10/2013 Norman
8,733,047 B1 5/2014 Hanson
8,733,048 B1 5/2014 Hanson
8,753,162 B2 6/2014 Jensen
8,904,724 B1 12/2014 Hanson
D722,346 S 2/2015 Kasahara
9,163,393 B2 * 10/2015 Carroll ..... E04H 1/00
D757,186 S 5/2016 Hattori
D757,187 S 5/2016 Hattori
D763,365 S 8/2016 Timg
D763,366 S 8/2016 Timg
D767,044 S 9/2016 Timg
D767,045 S 9/2016 Timg
D769,986 S 10/2016 Timg
9,731,214 B2 8/2017 Lindaman
9,734,733 B2 * 8/2017 Murtagh ..... G09B 25/04
2002/0193046 A1 * 12/2002 Zebersky ..... A63H 3/52 446/476
2014/0315466 A1 * 10/2014 Murtagh ..... G09B 25/04 446/124

* cited by examiner

WALL ASSEMBLY AND ALIGNMENT CLIPS FOR ASSEMBLING MINIATURE MODEL BUILDINGS

This application claims priority to U.S. Ser. No. 62/304,486 filed in the U.S. Patent and Trademark Office on Mar. 7, 2016, the entirety of which is incorporated herein by reference.

FIELD OF INVENTION

The invention relates generally to toy houses, crafted structures, and miniature model buildings. More particularly, the invention relates to a wall component having associated alignment clips for interlocking adjacent wall segments and related model pieces with the wall component.

BACKGROUND OF THE INVENTION

Toy, craft, and miniature model buildings are often sold or assembled with model pieces (e.g., cabinets, fixtures, and appliances) that are either permanently mounted or left entirely detached from a wall segment following completed assembly of the model building. A typical modeling process requires an assembler to first assemble structural elements, such as wall segments, in a desirable configuration before adding model pieces to interior spaces. Whether the model building features permanently affixed or freely detached model pieces, however, often depends on whether the assembler is attempting to construct a predetermined layout or visualize a variety of arrangements. Nevertheless, regardless of which placement technique is utilized, each method presents inherent disadvantages for model building assemblers.

When an assembler is attempting to build a model in accordance with a predetermined layout or design, it may be desirable for the assembler to permanently glue or otherwise affix model pieces directly to the wall segments. This technique may become problematic when spectators wish to visualize an alternative configuration for the model pieces because it requires the assembler to forcibly remove model pieces from their mounted position and re-glue or re-attach the pieces at a different location. In some instances, repositioning the pieces may cause damage to the wall segment based on the forcible nature of their removal and bring about a need for the assembler to perform additional work or undesirable repairs to the model building.

In recognition of the problems associated with permanently affixing model pieces to wall segments, the assembler may choose to freely place model pieces within interior spaces and leave them rest as unsecured components. The problem with this approach, however, is that if the model building is moved or if its resting surface is bumped, model pieces may become jarred from their desired position and require the assembler to once again reposition them.

Accordingly, there is a need to develop a wall component that not only facilitates the connection of adjoining wall segments but also overcomes the disadvantages associated with having to make a firm decision between utilizing permanently affixed or entirely detached model pieces. Specifically, it would be desirable to develop a wall component that permits secure but releasable attachment of such pieces so that rearrangement of the pieces can be achieved in other releasably secure positons with minimal or no damage to the wall component or model pieces.

SUMMARY OF THE INVENTION

It is an object of the invention to overcome problems associated with the existing art.

Another object of the invention is to provide a novel model building component for architectural modeling.

A further object of the invention is to provide an architectural model that is reconfigurable with minimal effort or damage to the model.

Still another object of the invention is to provide a wall component that permits releasably secure attachment of model pieces.

Still a further object of the invention is to provide a model piece alignment clip that allows for movement of a connected model piece with respect to a wall segment.

Yet another object of the invention is to provide a wall segment alignment clip that permits releasably secure connection of adjacent wall segments.

These and other objects are satisfied a wall segment for assembling model buildings, comprising: a wall panel having an inner surface, an outer surface, an abutment edge, and a wall panel slot; a wall segment alignment clip affixed to the wall panel along the abutment edge; a molding frame having a central stopping strip and a lateral perimeter strip including a lateral slot, the molding frame affixed to the inner surface of the wall panel so that the lateral slot is aligned with the wall panel slot; and a molding strip having at least one mounting stud extending therefrom, the mounting stud being inserted through the aligned wall panel slot and lateral slot and abutting the central stopping strip such that a clip receiving gap is formed between the molding strip and the outer surface of the wall panel.

The foregoing and still other objects are satisfied by a wall component for receiving associated alignment clips, comprising: a molding frame having a central stopping strip and a lateral perimeter strip including a lateral slot; and a molding strip having an inner surface with at least one mounting stud extending therefrom, the mounting stud being inserted through the lateral slot and abutting the central stopping strip such that a clip receiving gap is formed along the inner surface of the molding strip.

The foregoing and still other objects are satisfied by a model building kit, comprising: (1) a wall panel having an inner surface, an outer surface, an abutment edge, and a wall panel slot; a wall segment alignment clip affixed to the wall panel along the abutment edge; a molding frame having a central stopping strip and a lateral perimeter strip including a lateral slot, the molding frame affixed to the inner surface of the wall panel so that the lateral slot is aligned with the wall panel slot; and a molding strip having at least one mounting stud extending therefrom, the mounting stud being inserted through the aligned wall panel slot and lateral slot and abutting the central stopping strip such that a clip receiving gap is formed between the molding strip and the outer surface of the wall panel; and (2) one or more model pieces having a backside and a corner, each model piece comprising: a model piece slot in the backside of the model piece; a model piece alignment clip operatively engaged to the model piece slot; a recessed area along the model piece slot configured to keep the model piece alignment clip flush with the backside of the model piece; and a notch disposed in the corner of the model piece configured to fit around an adjacent molding strip.

The foregoing and still other objects are satisfied by a method of assembling a wall segment having a wall panel including a wall panel slot, a molding strip having at least one mounting stud extending therefrom, and a molding frame including a lateral slot and a central stopping member, comprising: aligning the lateral slot with the wall panel slot; affixing the molding frame to the wall panel; and inserting the mounting stud through the aligned wall panel slot and lateral slot to abut the central stopping member, thereby forming a clip receiving gap between the molding strip and the wall panel.

The present invention contemplates a wall component that permits a releasably secure connection to adjoining wall segments and other model pieces, such as cabinets, fixtures, and appliances. In embodiments, a molding frame is inserted between two wall panels and mounted with its distal edge flush along a top or a bottom edge of the two wall panels. In a preferred embodiment, wall segments comprising the two wall panels, have molding frames that are mounted along both the top and bottom edges of the wall panels.

The wall component is comprised of a molding frame, mounting studs, and molding strips that resemble either ceiling or floor molding depending on whether the wall component is positioned at the top or bottom of a wall segment. The molding frame is dimensioned to provide the wall segment with a proportionate model building wall thickness. Mounting studs are then used to connect the outwardly positioned ceiling or floor molding strips to the molding frame.

In a preferred embodiment, the molding frame is comprised of a rectangular framework with a central stopping strip which stretches across a centerline of the framework and is parallel to two lateral perimeter strips. Each lateral perimeter strip preferably incorporates a lateral slot for receiving preferably cylindrical mounting studs. An array of mounting studs are affixed at their first ends to the molding strip and (once the wall component is assembled) extend through and beyond the wall panel and the lateral slot to connect to the central stopping strip at their second ends.

A gap is created by a space that is present between the interior side of the molding strip and the exterior side of the wall panel. The gap is formed for receiving alignment clips of model pieces (e.g., cabinets, fixtures, appliances, etc.). In an embodiment, model piece alignment clips are shaped to releasably interlock with a portion of the mounting studs that spans the clip receiving gap. It is preferable for the model piece alignment clip of top-mounted model pieces to releasably interlock with at least two mounting studs. In other embodiments, such as those featuring bottom-mounted model pieces, it is preferable for the model piece alignment clip to have a tab that hooks over the molding strip and is inserted in the clip receiving gap between a set of mounting studs.

The present invention also contemplates a model piece alignment clip that is adjustable with respect to the model piece. Given that the array of mounting studs are incrementally spaced along a top or bottom edge of the wall segment, a non-adjustable model piece alignment clip would only permit the model piece to be secured in corresponding incremental positions. Therefore, it is preferable to have a model piece alignment clip that is also adjustable with respect to the model piece. In some embodiments, a lateral slot is incorporated into the model piece for receiving a sliding portion of the model piece alignment clip. The model piece may then be slid in lateral directions relative to the model piece alignment clip to achieve a continuous range of lateral positions along the wall segment, as opposed to just incremental positons. When the lateral slot of the model piece is longer than the incremental spacing of the array of mounting studs, it becomes possible to secure the model piece at any lateral position along the wall segment.

The invention further contemplates a wall segment alignment clip for releasably interlocking wall segments in a perpendicular direction. In a preferred embodiment, wall segment alignment clips are affixed at the top and bottom of an abutment edge of the wall segment. The wall segment alignment clips are likewise configured to be received by the corresponding clip receiving gap formed between the molding strip and the wall panel at the top and bottom of adjacent wall segments. When the wall segment alignment clips are received by the wall component, a secure but releasable connection is formed between the wall segments.

The terminology used herein is for the purpose of describing particular embodiments only and is not intended to be limiting of the invention.

As used herein, the singular forms, "a", "an" and "the" are intended to include the plural forms as well, unless the context clearly indicates otherwise. It will be further understood that the root terms "include" and/or "have", when used in this specification, specify the presence of stated features, steps, operations, elements, and/or components, but do not preclude the presence or addition of at least one other feature, step, operation, element, component, and/or groups thereof.

For definitional purposes and as used herein "attached", "connected", and "secured" includes physical, whether direct or indirect, affixed or adjustably mounted. Thus, unless specified, "attached", "connected", and "secured" is intended to embrace any operationally functional connection.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

In this detailed description, references to "one embodiment", "an embodiment", or "in embodiments" mean that the feature being referred to is included in at least one embodiment of the invention. Moreover, separate references to "one embodiment", "an embodiment", or "embodiments" do not necessarily refer to the same embodiment; however, neither are such embodiments mutually exclusive, unless so stated, and except as will be readily apparent to those skilled in the art. Thus, the invention can include any variety of combinations and/or integrations of the embodiments described herein.

For definitional purposes and as used herein the term "model piece" is defined as a miniaturized replica of a household item, such as cabinets, fixtures, appliances, or the like and connotes a component constructed by 3D printing or other architectural modeling materials.

As used herein, and unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

For definitional purposes and as used herein the term "wall component" is defined as a device for releasably securing a model piece to a wall segment. A "wall component" comprises a molding strip, at least one mounting stud, and a molding frame.

For definitional purposes and as used herein the term "wall segment" is defined as an assembled section of model building wall preferably incorporating a wall component, a wall segment alignment clip, and a wall panel.

In the following description, reference is made to the accompanying drawings, which are shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

DETAILED DESCRIPTION OF THE DRAWINGS

Figure 1:
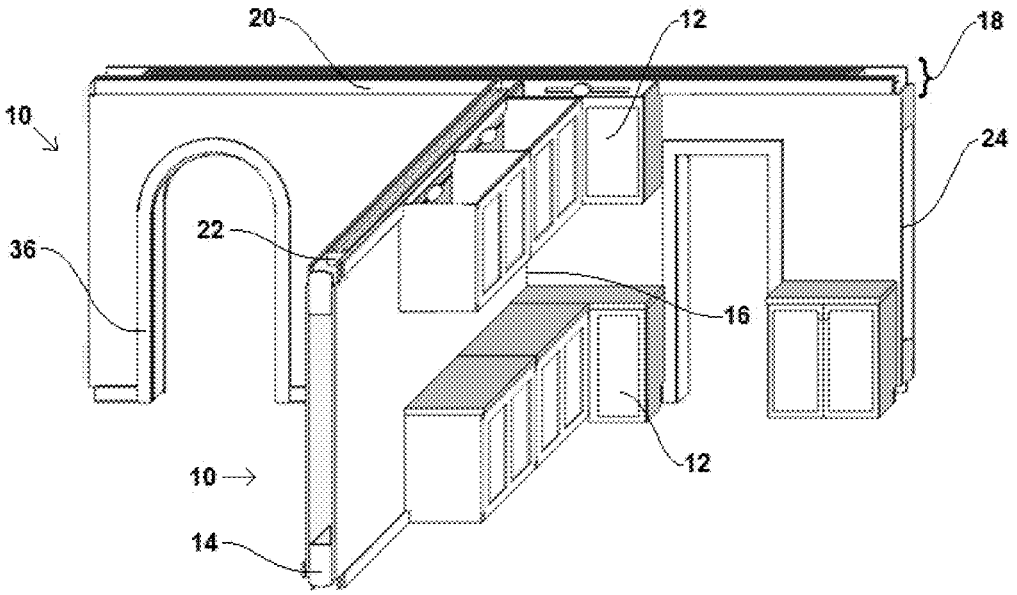
FIG. 1 illustrates a perspective view in accordance with an embodiment of the invention.
Figures 8A, 8B, 8C, 8D, 8E:
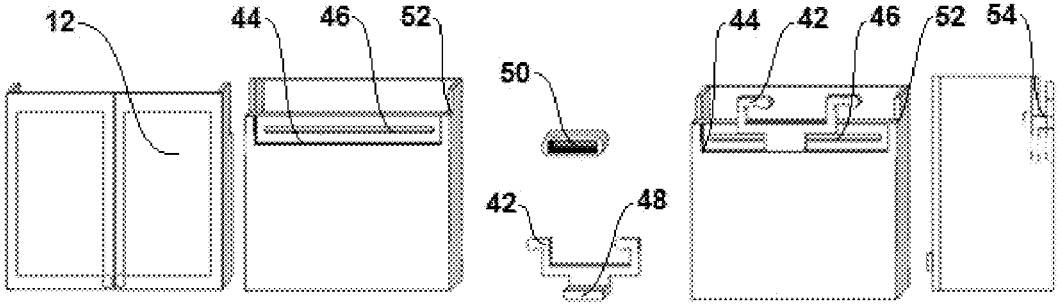
FIG. 8A illustrates a front perspective view of a model piece in accordance with an embodiment of the invention.
FIG. 8B illustrates a rear perspective view of a model piece in accordance with an embodiment of the invention
FIG. 8C illustrates a perspective of a securing cap and model piece alignment clip in accordance with an embodiment of the invention.
FIG. 8D illustrates a rear perspective view of a model piece and model piece alignment clip in accordance with an embodiment of the invention.
FIG. 8E illustrates a side elevation view of a model piece and model piece alignment clip in accordance with an embodiment of the invention.

FIG. 1 illustrates a connection between two perpendicular wall segments 10 having both top-mounted and bottom-mounted model pieces 12 affixed thereto. The wall segments 10 feature wall segment alignment clips 14 at the top and bottom of an abutment edge 16 that releasably connect the wall segment 10 to an adjacent wall component 18. Specifically, the wall segment alignment clips 14 are secured in a clip receiving gap that is formed between the molding strip 20 and the wall panel 24. The top-mounted model pieces 12 releasably connect to mounting studs 30 by a model piece alignment clip 42 (illustrated in FIG. 8C) that interlocks with the mounting studs 30 shown in FIG. 3B. The bottom-mounted model pieces 12 are likewise releasably connected to the wall segments 10, but by way of a model piece alignment clip 42 that fits inside the clip receiving gap between mounting studs 30 connected to a lower molding strip 20.

Figure 2:
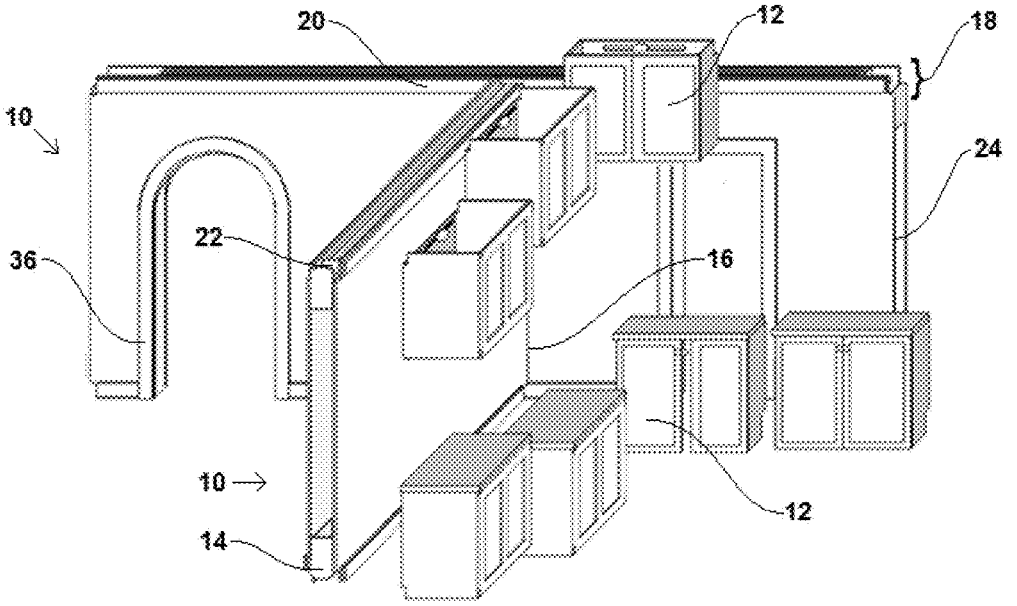
FIG. 2 illustrates a perspective view in accordance with an embodiment of the invention.

FIG. 2 illustrate an embodiment of the invention where the top-mounted and bottom-mounted model pieces 12 are detached from the wall segments 10. The ability to detach, rearrange, and re-connect model pieces 12 facilitates the assembler's ability to develop and asses the most desirable layout(s) for a select space without damaging the wall segments 10 or model pieces 12.

Figure 3A:
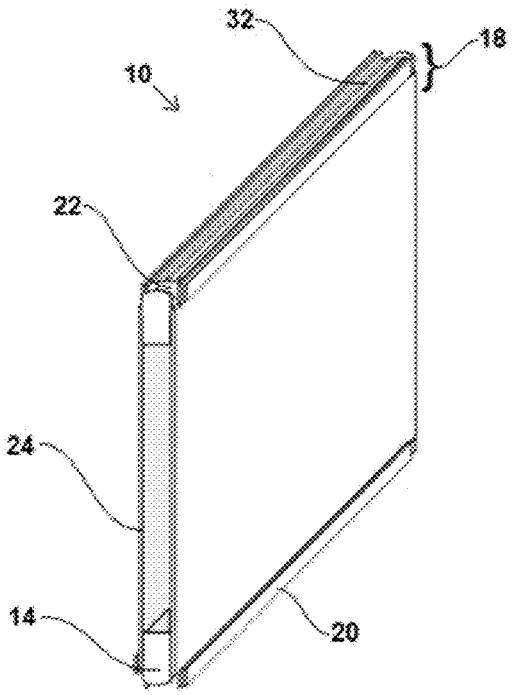
FIG. 3A illustrates a perspective view in accordance with an embodiment of the invention.
Figure 3B:
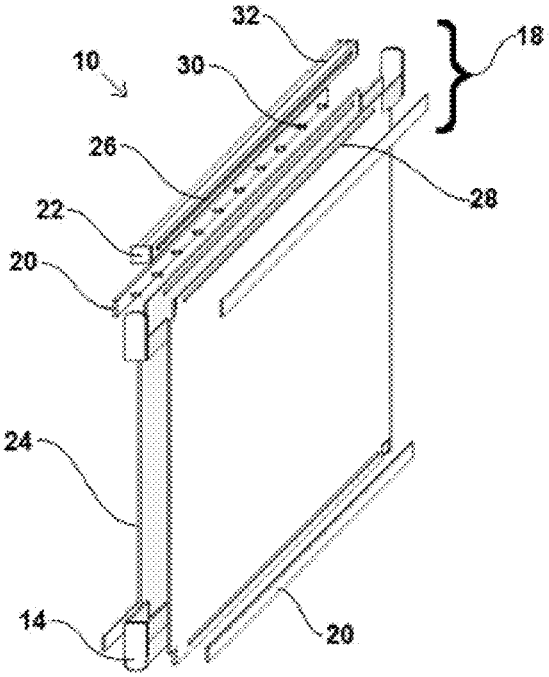
FIG. 3B illustrates an exploded perspective view in accordance with an embodiment of the invention.

FIGS. 3A-B illustrate, respectively, an assembled wall segment 10 and an exploded wall component 18 with associated wall segment alignment clips 14. The wall segment 10 is assembled by first affixing a molding frame 22 between two wall panels 24 along their top and/or bottom edges. The molding frame 22 comprises a lateral slot 26 on each lateral perimeter strip 33 that stretches substantially the length of the molding frame 22 and aligns with wall panel slots 28 incorporated into each wall panel 24. The wall panels 24 are preferably affixed to the molding frame 22 by glue or other similar methods of attachment. An array of mounting studs 30 affixed at their first ends to a molding strip 20 are then received by the aligned wall panel slot 28 and lateral slot 26. The mounting studs 30 are positioned to extend through the wall panel slot 28 and lateral slot 26 so that they abut a central stopping strip 32 and can be connected thereto at their second ends. The length of the mounting studs 30 are long enough to form a gap between the exterior surface of the wall panel 24 and the interior surface of the molding strip 20. The gap is useful for receiving model piece alignment clips 42. The model piece alignment clips 42 may wedge the clip receiving gap between studs 30 for releasably secure attachment or they may releasably interlock with portions of the mounting studs 30 that extend across the clip receiving gap.

Figure 3C:
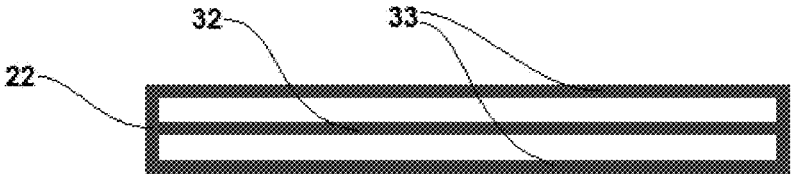
FIG. 3C illustrates a top view of a molding frame in accordance with an embodiment of the invention.

FIG. 3C illustrates a top view of a molding frame 22 comprising a rectangular framework with a central stopping strip 32 that stretches across a centerline of the molding frame 22 and is parallel to two lateral perimeter strips 33. The space between the central stopping strip 32 and lateral perimeter strip 33 receives the mounting studs 30 through the lateral slot 26 in the perimeter strip 33. The mounting studs 30 are then affixed at their second ends to the central stopping strip 32.

Wall segment alignment clips 14 are also secured between two wall panels 24 in a position that permits them to connect to adjacent wall segments 10 in a perpendicular direction while providing additional strength to corner regions of the wall segment 10. The gap formed by the mounting studs 30 allows the wall segment alignment clips 14 to releasably connect to a corresponding wall component 18. The wall segment alignment clips 14 are preferably tab-shaped and oriented to fit inside the clip receiving gap between mounting studs 30 of the wall component 18.

Figure 4:
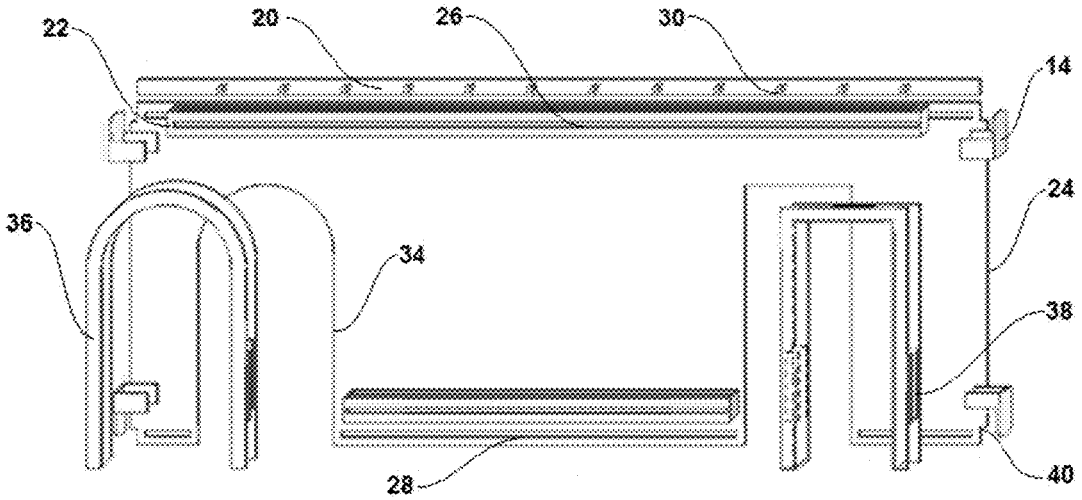
FIG. 4 illustrates a perspective view in accordance with an embodiment of the invention.
Figure 5A:
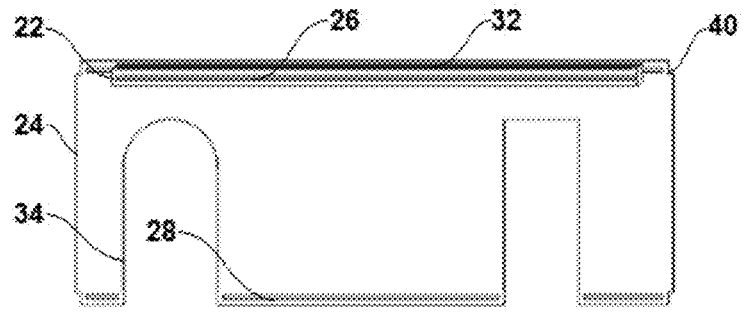
FIG. 5A illustrates an assembly step in accordance with an embodiment of the invention.
Figure 5B:
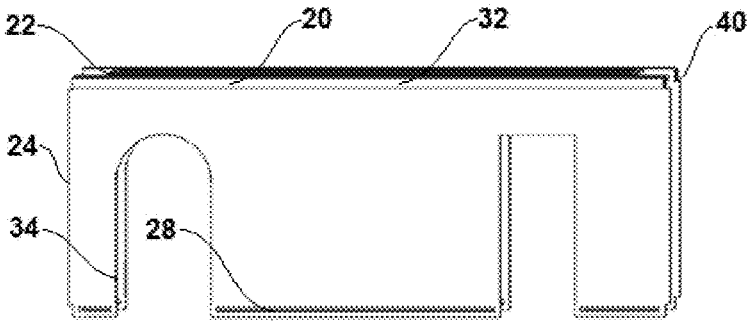
FIG. 5B illustrates an assembly step in accordance with an embodiment of the invention.
Figure 5C:
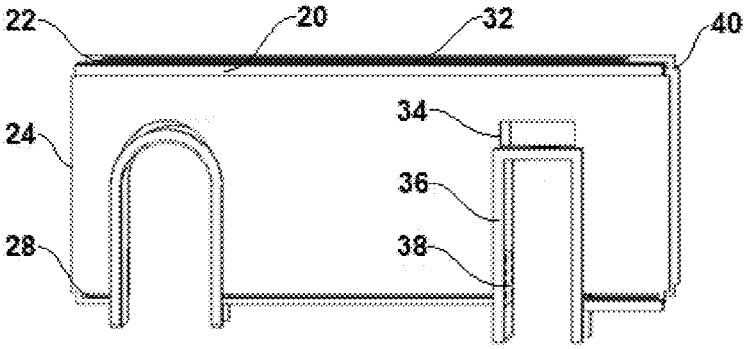
FIG. 5C illustrates an assembly step in accordance with an embodiment of the invention.
Figure 5D:
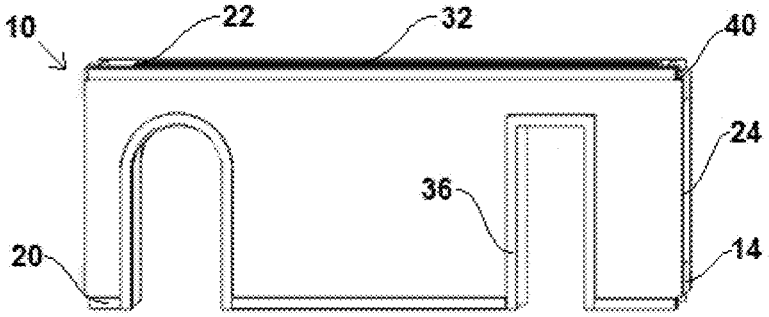
FIG. 5D illustrates an assembly step in accordance with an embodiment of the invention.

FIG. 4 illustrates an embodiment of a wall panel 24 having door openings 34 and doorway molding frames 36. The doorway molding frames 36 are preferably channel shaped and comprise flanged edges that exhibit a molding-like surface on each side of a wall segment 10. Spacers 38 are incorporated into the doorway molding frame 36 to create parallel gaps of substantially the same thickness as a wall panel 24. The wall panels 24 are then slid through the gaps created by the spacer 38 to secure the doorway molding frame 36 in place. Those skilled in the art would appreciate that this technique may be used to accommodate many different shapes and sizes of door openings 34.

Further illustrated is a wall panel notch 40 located at a corner of the wall panel 24 and proximate to an end of the wall panel slot 28. The wall panel notch 40 is shaped to fit around an adjacent molding strip 20 when the wall panel 24 abuts a perpendicular wall segment 10. The wall panel notch 40 likewise permits the wall segment alignment clip 14 to extend into a cut-away region so that it may interlock with the molding strip 20 of adjacent wall segments 10.

FIGS. 5A-D illustrate steps for assembling a wall segment 10 in accordance with an embodiment of the invention. A molding frame 22 is mounted along an upper edge of a wall panel 24 so that the lateral slot 26 and the wall panel slot 28 are aligned. The opposite side of the molding frame 22 is affixed to a second wall panel 24 along its upper edge, once again aligning the lateral slot 26 with the wall panel slot 28. An array of mounting studs 30 connected to the molding strip 20 are inserted through the slots (26, 28) and connected to the central stopping strip 32. Doorway molding frames 36 are slid into the door openings 34 (if door openings are desired). A second molding frame 22 is mounted between the wall panels 24 so that the wall panel slot along the lower edge is aligned with the lateral slots 26. The array of mounting studs 30 of the lower molding strips 20 are inserted through the slots (26, 28) along the lower edge and connected to the stopping strip 32. Wall segment alignment clips 14 are mounted between the wall panels 24 proximate to corners of the wall segment 10.

Figure 6A:
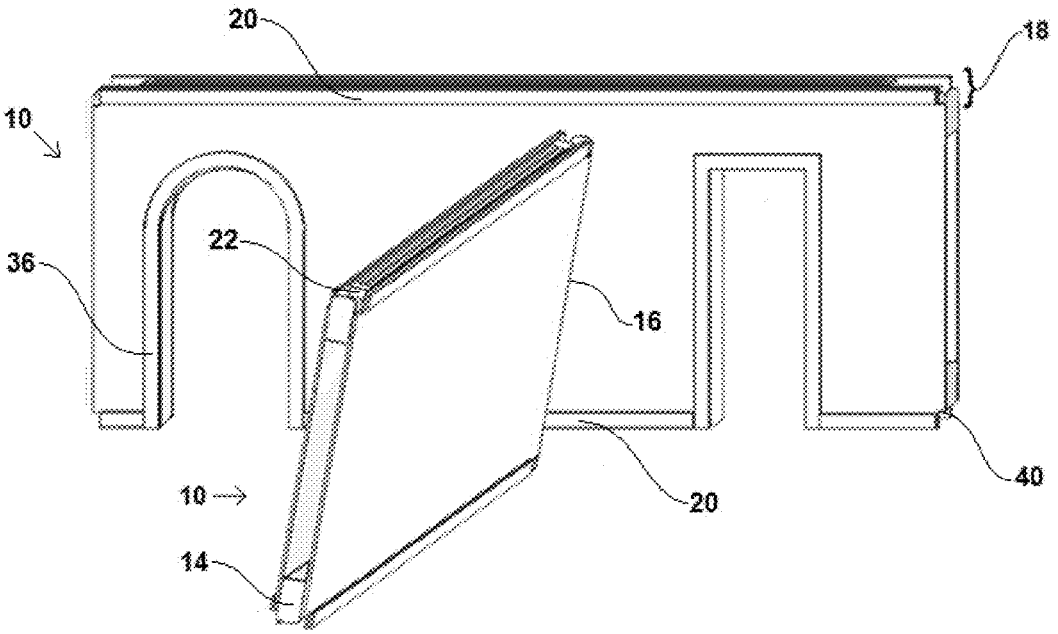
FIG. 6A illustrates a perspective view of an assembly step in accordance with an embodiment of the invention.
Figure 6B:
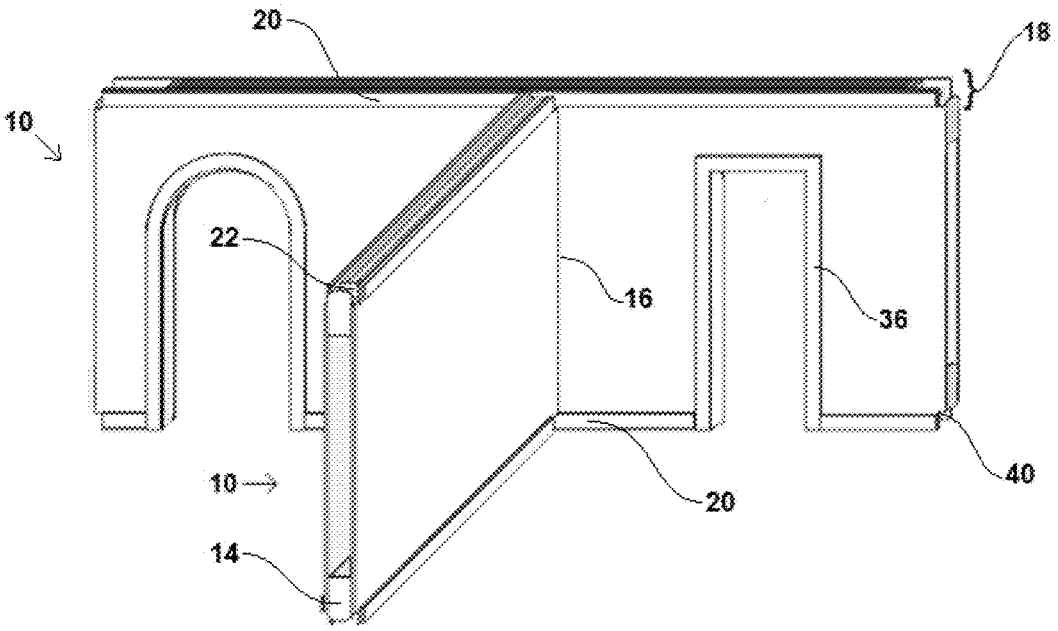
FIG. 6B illustrates a perspective view in accordance with an embodiment of the invention.

FIGS. 6A-B illustrate interconnecting wall segments 10 forming a wall segment assembly. Specifically, a first wall segment 10 is tilted so that its wall segment alignment clips 14 can be maneuvered into the clip receiving gaps located behind the upper and lower molding strips 20 of a second, adjacent wall segment 10. FIG. 6B illustrates a wall segment assembly comprising first and second wall segments. It will be apparent to the skilled artesian based on the instant disclosure that a complete building structure may be assembled using the teachings disclosed herein by interconnecting multiple wall segments.

Figures 7A, 7B, 7C, 7D, 7E:
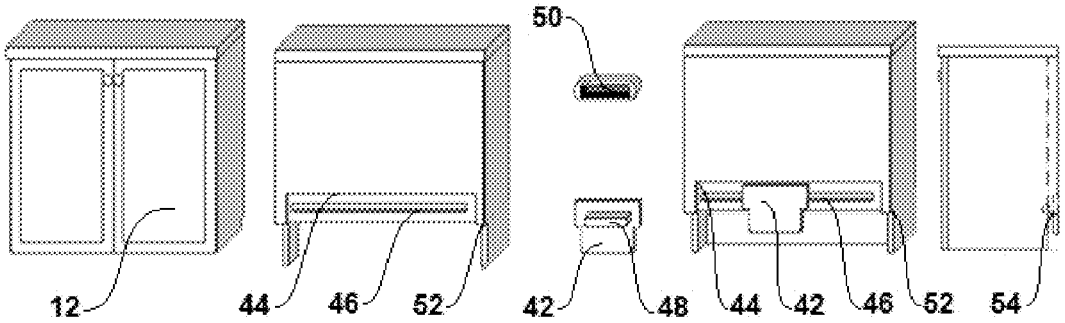
FIG. 7A illustrates a front perspective view of a model piece in accordance with an embodiment of the invention.
FIG. 7B illustrates a rear perspective view of a model piece in accordance with an embodiment of the invention.
FIG. 7C illustrates a perspective of a securing cap and model piece alignment clip in accordance with an embodiment of the invention.
FIG. 7D illustrates a rear perspective view of a model piece and model piece alignment clip in accordance with an embodiment of the invention.
FIG. 7E illustrates a side elevation view of a model piece and model piece alignment clip in accordance with an embodiment of the invention.

FIGS. 7A-E illustrate an embodiment of a bottom-mounted model piece 12 and model piece alignment clip 42. The model pieces 12 of the present invention may be constructed, for example, using 3D printing technology. FIG. 7B illustrates a model piece 12 featuring a recess 44 which incorporates a model piece slot 46. The model piece alignment clip 42 of FIG. 7C features a tab 48 that is inserted through the model piece slot 46 so that the model piece 12 and the alignment clip 42 can be slid laterally relative to each other. A securing cap 50 is placed over the tab 48 once it has been inserted through the model piece slot 46 to keep the alignment clip 42 slidably secured to the model piece 12.

The model piece 12 also features a model piece notch 52 that is shaped to fit around a corresponding molding strip 20 so that the back of the model piece 12 can be positioned tight against a wall panel 24. In addition, the recess 44 creates a space to be filled by the model piece alignment clip 42 so that it is also flush with the back of the model piece 12 and can be slid laterally relative to the model piece 12 without jarring the model piece 12 away from the wall panel 24. As illustrated in FIGS. 7D-E, the model piece alignment clip 42 extends into the notched region and forms a groove 54 that interlocks with a corresponding molding strip 20.

FIGS. 8A-E illustrate an embodiment of a top-mounted model piece 12 and model piece alignment clip 42. In the illustrated embodiment, the model piece alignment clip 42 is shaped to interlock with two mounting studs 30 in order to hang the model piece 12 from the mounting studs 30 of a ceiling molding strip 20. The illustrated model piece 12 also features a model piece notch 52, a recess 44, and a model piece slot 46. As with previous embodiments, a securing cap 50 is used to slidably secure the model piece alignment clip 42 to the model piece 12.

Although selected embodiments of the invention have been described in the forgoing specification, it is understood by those skilled in the art that many modifications and embodiments of the invention will come to mind to which the invention pertains, having benefit of the teaching presented in the foregoing description and associated drawings. It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for purposes of limiting the description of the invention.

What is claimed is:

1. A model building kit, comprising:

(1) a wall panel having an inner surface, an outer surface, an abutment edge, and a wall panel slot;

a wall segment alignment clip affixed to the wall panel along the abutment edge;

a molding frame having a central stopping strip and a lateral perimeter strip including a lateral slot, the molding frame affixed to the inner surface of the wall panel so that the lateral slot is aligned with the wall panel slot; and a molding strip having at least one mounting stud extending therefrom, the mounting stud being inserted through the aligned wall panel slot and lateral slot and abutting the central stopping strip such that a clip receiving gap is formed between the molding strip and the outer surface of the wall panel; and (2) one or more model pieces having a backside and a corner, each model piece comprising:

a model piece slot in the backside of the model piece;

a model piece alignment clip operatively engaged to the model piece slot;

a recessed area along the model piece slot configured to keep the model piece alignment clip flush with the backside of the model piece; and a notch disposed in the corner of the model piece configured to fit around an adjacent molding strip.

* * * * *